US008353387B2

(12) United States Patent
Vollenweider et al.

(10) Patent No.: US 8,353,387 B2
(45) Date of Patent: Jan. 15, 2013

(54) LADDER SAFETY APPARATUS

(75) Inventors: Edgar G. Vollenweider, Slidell, LA (US); Michael Campesi, White Castle, LA (US)

(73) Assignee: M.A. Campesi Family Holdings, LLC, White Castle, LA (US)

( * ) Notice: Subject to any disclaimer, the term of this patent is extended or adjusted under 35 U.S.C. 154(b) by 408 days.

(21) Appl. No.: 12/229,379

(22) Filed: Aug. 22, 2008

(65) Prior Publication Data

US 2010/0044151 A1 Feb. 25, 2010

(51) Int. Cl.
*A62B 1/16* (2006.01)

(52) U.S. Cl. ..... 182/8

(58) Field of Classification Search ..... 182/8
See application file for complete search history.

(56) References Cited

U.S. PATENT DOCUMENTS

| | | | | | |
|---|---|---|---|---|---|
| 1,382,396 | A * | 6/1921 | Szymanske | 414/794.6 |
| 1,916,208 | A * | 7/1933 | Diou | 182/8 |
| 3,348,632 | A * | 10/1967 | Swager | 182/230 |
| 3,451,161 | A * | 6/1969 | Lemelson | 446/138 |
| 3,885,647 | A * | 5/1975 | Acosta | 182/8 |
| 4,085,818 | A * | 4/1978 | Swager | 182/48 |
| 4,111,280 | A | 9/1978 | Devine et al. | |
| 4,269,284 | A * | 5/1981 | Swager | 182/8 |
| 4,643,377 | A | 2/1987 | Christianson | |
| 4,712,754 | A | 12/1987 | Brodie | |
| 6,161,647 | A * | 12/2000 | Braden et al. | 182/8 |
| 6,209,610 | B1 * | 4/2001 | Davies et al. | 160/26 |
| 6,471,000 | B2 | 10/2002 | Wolfe | |
| 2007/0158137 | A1 * | 7/2007 | Petersen | 182/8 |
| 2007/0193824 | A1 * | 8/2007 | Anderson | 182/8 |

OTHER PUBLICATIONS http://www.merriam-webster.com/dictionary/serrate.*

* cited by examiner

*Primary Examiner* — Katherine w Mitchell
*Assistant Examiner* — Candace L Bradford
(74) *Attorney, Agent, or Firm* — Keaty Law Firm, LLC

(57) ABSTRACT

A safety accessory for use with a ladder to slow the speed of an accidental fall of a worker, who works in an elevated position. The accessory has a C-shaped track member and a slide body that moves inside the track member. The worker's harness is secured to the slide body. Contact surfaces of the track member and the slide member are serrated to slow the speed of an accidental fall. A plurality of locking wedge members is positioned in the channel formed by the track member to further decrease the speed of an accidental fall.

5 Claims, 3 Drawing Sheets

LADDER SAFETY APPARATUS

BACKGROUND OF THE INVENTION

The present invention relates to safety devices, and more particularly to safety devices that can be used with ladders or scaffolds in a variety of different environments.

Government regulations, as well as general safety considerations require the use of a safety device, such as rope or harness whenever a worker works in elevated positions. Such devices are designed to be fastened to the worker via a safety waist belt or harness via a lanyard. The safety harness is then designed to be attached to a safety line, which in turn is attached to some elevated structure independently of the ladder or scaffold. In the event of a fall, the safety device is designed to slow the descent and/or lock the safety line in a position above ground to thereby prevent injury to the worker.

Conventional safety harnesses have suffered from numerous disadvantages. For example, it is believed that prior art harnesses have been difficult and time consuming for a person to initially put on prior to their ascent. Additionally, after a person wearing a prior art harness became suspended by the rope grab and safety line, the suspended person oftentimes found it very difficult to connect the harness to a lowering device. Other disadvantages of some of the known safety devices refer to the fact that the descent is made too fast with a possibility that the locking device would not stop a fall, Accordingly, there exists a need for a safety device to be used in any type of system or environment for supporting a person at a position elevated from the ground, while facilitating locking engagement of the safety deice much faster than it is possible with conventional safety systems.

SUMMARY OF THE INVENTION

It is therefore, an object of the present invention to provide a safety apparatus for workers working at elevated positions and wearing a safety belt or safety harness.

It is another object of the invention to provide a safety apparatus and methods of use for protecting persons located at elevated positions from falling while arresting the fall and enabling such persons to safely descend.

It is a further object of this invention to provide a safety system which is simple in construction, easy to use and which effectively protects a person from falling from an elevated position while enabling the safe controlled descent therefrom.

These and other objects of the invention are achieved through a provision of a safety apparatus for protecting a user during an accidental fall, which comprises an elongated track member detachably securable to a side of a ladder in a generally parallel relationship to the ladder. The track member has a generally C-shaped cross-section with a pair of side portions joined by a web, each of said side portions carrying edge portions to form a channel. The web and inner surfaces of the edge portions are formed with serrations along contact surfaces. A slide body is positioned for slidable movement within the channel, the slide body being detachably engageable to a harness worm by the user.

The slide body has a cam member with contact surfaces adapted for engaging serrations of the track member and slowing speed of an accidental fall. The contact surfaces of the slide member are similarly provided with serrations that mesh with serrations of the track member in case of an accidental fall. A plurality of wedge-shaped locking members is positioned along the web for contacting the cam member and further slowing down the speed of the user's fall.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
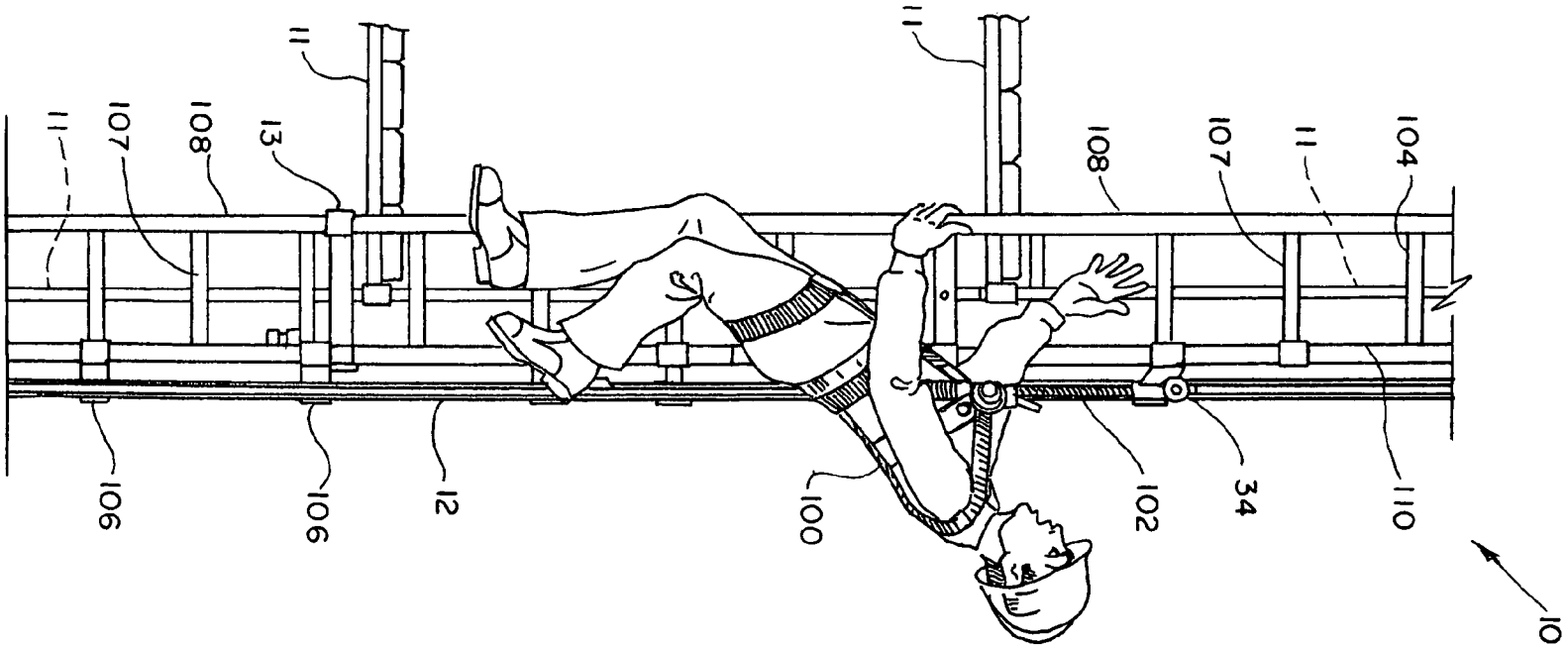
FIG. 1 is a perspective view illustrating position of the safety apparatus of the present invention adjacent a scaffold.
Figure 2:
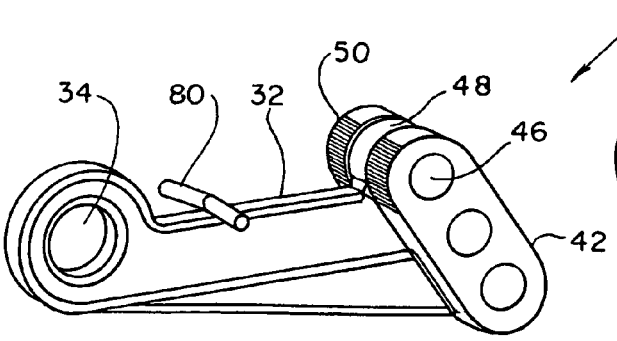
FIG. 2 is a perspective view of the locking member of the apparatus of the present invention.
Figure 3:
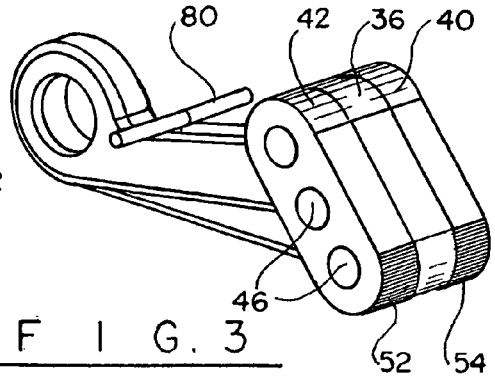
FIG. 3 is a perspective view of the locking member of the apparatus of the present invention showing teethed portions on a lower part of the slide body.
Figure 4:
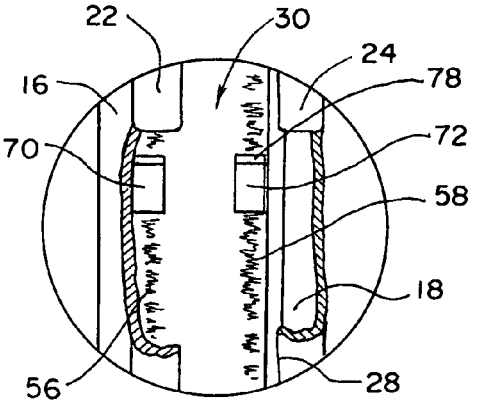
FIG. 4 is a detail partially cut-away view illustrating a pair of locking wedges mounted in a bottom of an elongated channel formed by a track member.
Figure 5:
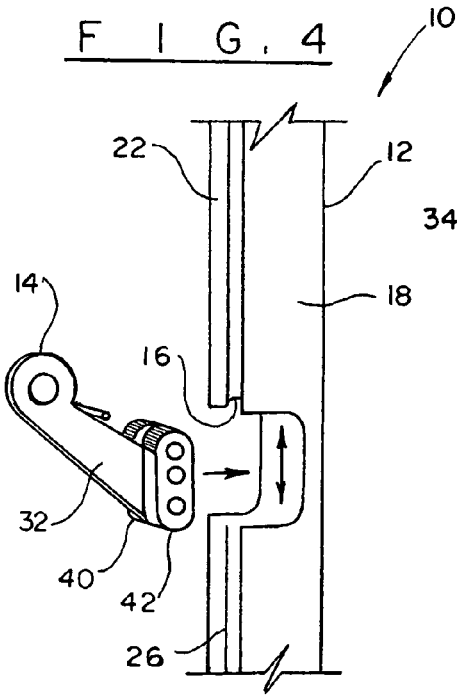
FIG. 5 is a schematic view illustrating engagement of the locking member with the track member.
Figure 6:
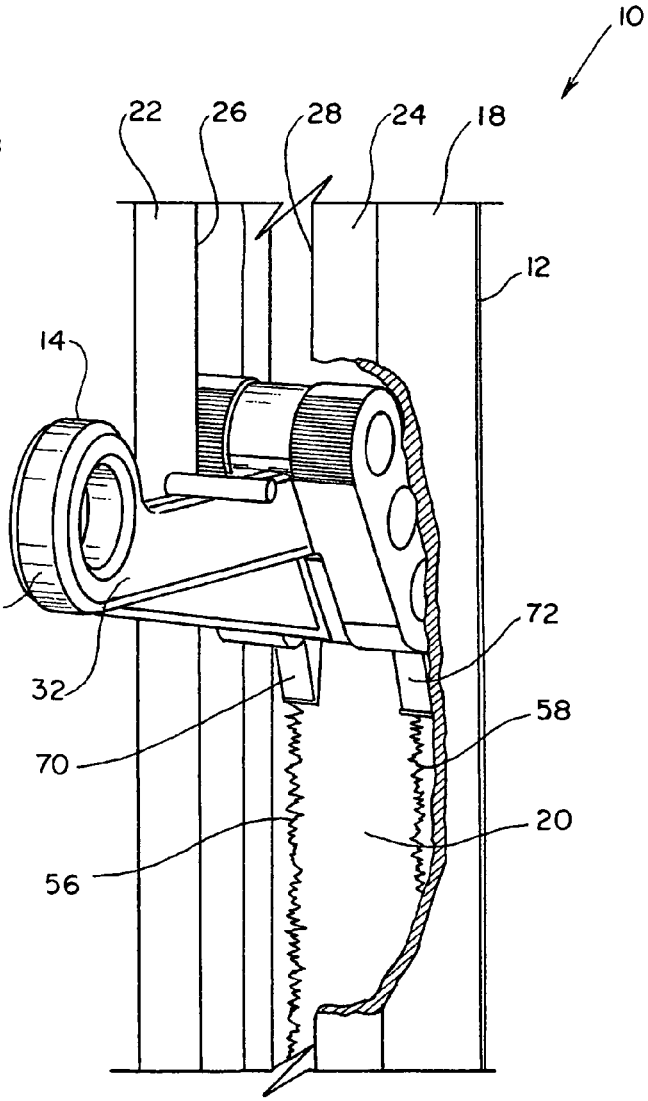
FIG. 6 illustrates locking engagement of the slide body with the locking wedges.
Figure 7:
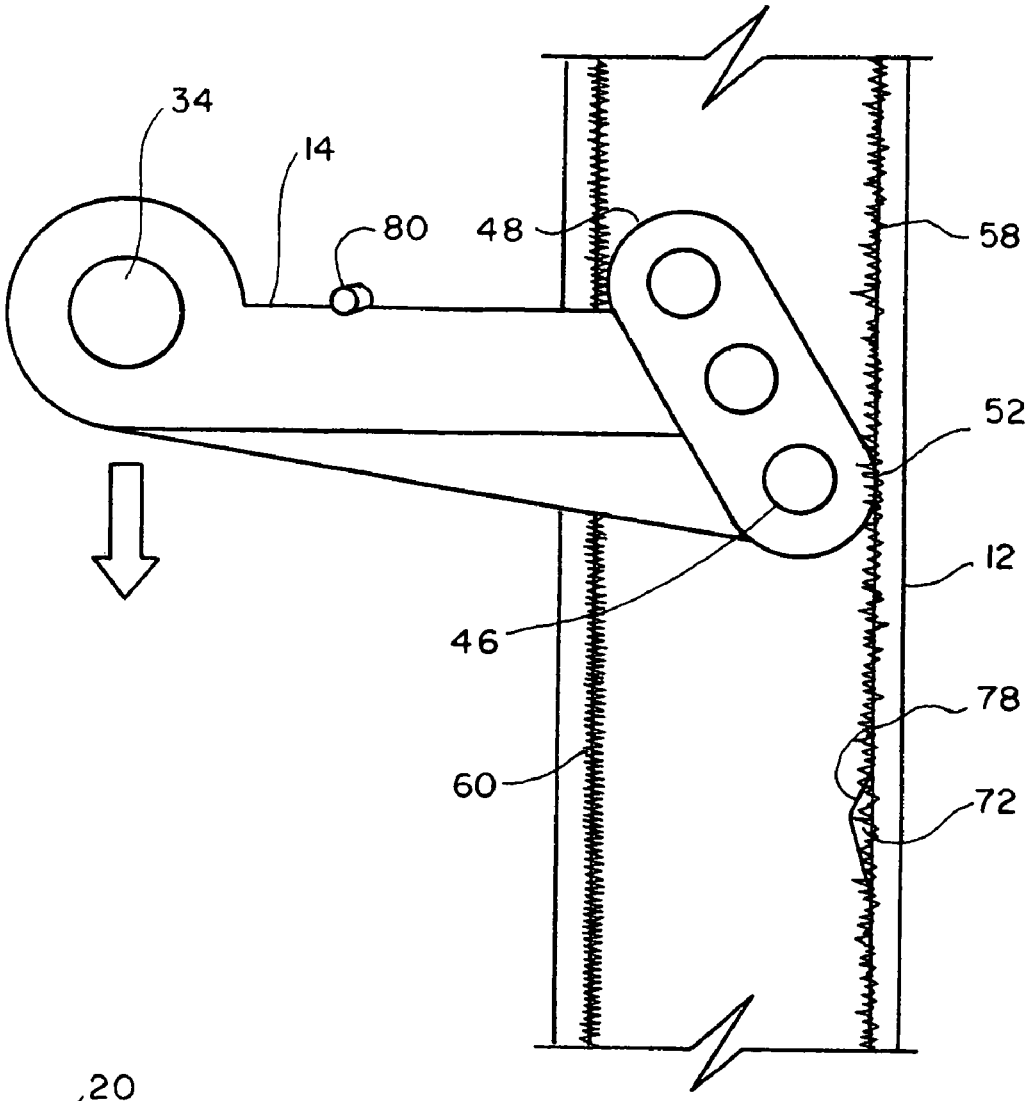
FIG. 7 is a partially cross-sectional view illustrating engagement of the slide body within the channel of the track member.
Figure 8:
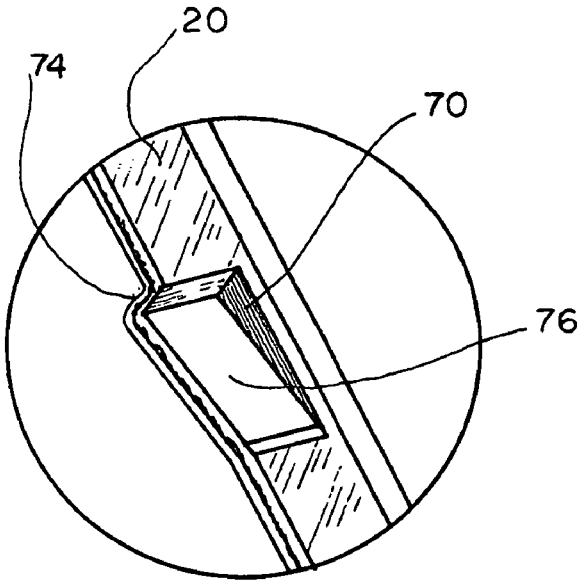
FIG. 8 is a detail view showing a locking wedge used in the apparatus of the present invention.

Turning now to the drawings in more detail, numeral 10 designates the safety apparatus of the present invention. The apparatus 10 comprises an elongated track member 12 and a slide body 14, which is adapted for sliding movement within the track member 12. The track member 12 comprises two parallel sides 16, 18 and a transverse joining web 20. The sides 16 and 18 each have inwardly facing edge portions 22, 24, respectively, which face inward in opposite directions to define a channel member of a generally C-shaped cross-section.

A gap 30 is formed between innermost edges 26, 28 of the edge portions 22, 24. The gap is large enough to allow extension of the arm of the slide body 14, while preventing disengagement of the sliding body 14 from the channel formed by the track member 12.

The slide body 14 comprises an arm 32 having a unitary formed eyelet 34 at a distal end portion and a cam section 36 at its proximate end portion. The eyelet 34 allows attachment of a safety cable or harness belt 102 to the slide body 14. The slide body 14 further comprises a cam member 38 formed by a pair of parallel cam portions 40, 42. The cam section 36 and cam portions 40, 42 are secured together by a plurality of pins 46 extending through the cam portions 40, 42 and the cam section 36. The cam portions 40, 42 and the cam section 36 are secured at an angle to the arm 32, as shown in the drawings.

The cam portions 40, 42, as well as the cam section 36, have a generally oval configuration with opposed curved ends. When the slide body 14 is engaged in the channel defined by the track 12, at least portions of the cam portions 40, 42 frictionally engage the channel walls. To increase the friction during the sliding movement, such as during a fall, the contact surfaces of the cam portions are provided with upwardly facing serrations, or teeth 48, 50 at upper curved ends of the cam portions 42, 40, respectively, as well as upwardly facing serrations or teeth 52, 54 at lower ends of the cam portions 42, 40.

The web 20 of the track member 12 is provided with two parallel rows of serrations 56, 58 that are designed to mesh with teeth 54, 52 of the cam portions 40, 42 during a downward sliding movement of the slide body 14.

An inner surface 60 of the edge portion 22 is similarly provided with serrations, or teeth 60, which are adapted to mesh with the teeth 48 of the cam portion 42. A similar track of serrations is formed on the inner surface of the edge portion 24 for engagement with the teeth 50 of the cam portion 40.

To further increase safety of the worker 100 (shown in FIG. 1) suspended by the harness 102, the web 20 is provided with a plurality of wedge-shaped locking members 70, 72, which are positioned in two spaced rows along the inner surface of the web 20. The locking members 70, 72 are formed by punching out a portion of the web 20 inwardly, which may be performed without breaking the surface of the web 20. Preferably, the locking members 70, 72 are formed along the tracks formed by the rows of serrated teeth 56, 58, that is along the contact areas of the web 20.

The locking members 70, 72 form upwardly oriented wedges, each having an upper part 74 and a lower part 76. The upper part 74 extends at a greater distance outwardly from the inner surface of the web 20 as compared to the lower part 76. In effect, the upper part 74 forms an upwardly facing shoulder 78, which catches on the serrated portions 52, 54 and slows the speed of fall of the worker 100. If desired, the locking members 70, 72 can be spaced at six-inch, or twelve-inch intervals, or eighteen-inch intervals, etc. in parallel rows, along the contact surface of the web 20.

A cross member 80 is secured to the arm 32 to prevent disengagement of the slide body 14 from the track 12 and to facilitate alignment of the arm 32 during sliding movement within the channel formed by the track member 12. The cross member 80 is oriented substantially across the gap 30 when the slide body 14 is engaged with the track member 12.

The apparatus 10 can be secured to conventional ladder 104 by clamps, or fittings 106 spaced along the length of the track member 12. Conventional ladders 104 can have two parallel rails 108, 110 connected by rungs 107. The fittings or clamps 106 detachably secure the track member 12 to extend along one of the rails 108 or 110. The ladder 104 may be positioned adjacent a scaffold 11, and can be secured to the scaffold 11 by a plurality of brackets 13.

When the worker 100 climbs up the ladder 104 the upwardly oriented teeth of the track member 12 offer no resistance to the sliding movement of the cam portions 40, 42. However, should the worker 100 falls the downward movement is slowed down by the upwardly oriented aspects of the serrated teeth of the cam portions 40, 42 (engaged in double tracks along the web 20 and the inner surfaces of the edge portions 22, 24). Additionally, the speed of fall is substantially reduced by the locking members 70, 72, which anchor the slide body 14 within the track member 12.

Many changes and modifications can be made in the design of the present invention without departing from the spirit thereof. I, therefore, pray that my rights to the present invention be limited only by the scope of the appended claims.

We claim:

1. A safety apparatus for protecting a user during an accidental fall, comprising:

an elongated track member detachably securable to a side of a ladder, said track member forming a C-shaped channel having inwardly facing track side portions connected by a web;

a slide body slidingly moveable within the channel, said slide body being detachably engageable to a harness worn by the user; and a means positioned on the slide body, on inner surfaces of the track side portions and on the web of the track member for decreasing speed of an accidental fall, said speed decreasing means comprises a plurality of serrations formed about contact surfaces of the slide body and a plurality of serrations formed along contact surfaces of the inner surfaces of the track side portions and the web of the track member, said serrations having upwardly oriented aspects allowing serrations of the slide body mesh with the serrations of the track side portions and the web of the track member during an accidental fall, wherein each of the side portions are disposed parallel to each other, each side portion carrying an inwardly folded edge portion, said serrations are formed along the web and inner surface of the edge portion, and wherein said cam member comprises a pair or parallel cam portions and a cam section unitary connected to the proximate end of the arm and sandwiched between the cam portions, and wherein the contact surfaces of the cam portions are provided with upwardly facing serrations at upper curved ends of the cam portions disposed for engagement with the serrations on the inner surfaces of the edge portions and with upwardly facing serrations at lower curved ends of the cam portions disposed for engagement with the serrations formed along the web of the track member.

2. The apparatus of claim 1, wherein said speed decreasing means further comprises a plurality of spaced-apart locking members positioned along contact surfaces of the track member and extending into said channel, said locking members engaging the slide body during an accidental fall.

3. The apparatus of claim 2, wherein each of said locking members has a generally wedge-shaped configuration with an upwardly facing shoulder that forms a stop when the slide body moves downwardly inside the track member.

4. The apparatus of claim 1, wherein said track member comprises an elongate body having a generally C-shaped cross-section.

5. The apparatus of claim 1, wherein said slide body comprises an arm having a distant end and a proximate end, an eyelet positioned at a distant end for engaging with the harness worn by the user and a cam member positioned at a proximate end of the arm, said cam member moving inside the track member.

* * * * *